United States Patent [19]

Pyle

[11] Patent Number: 5,054,357

[45] Date of Patent: Oct. 8, 1991

[54] MARCHING PERCUSSION INSTRUMENT STAND

[76] Inventor: Mark C. Pyle, 5726 Ludington, Houston, Tex. 77035

[21] Appl. No.: 545,199

[22] Filed: Jun. 28, 1990

[51] Int. Cl.[5] ..... G10D 13/02

[52] U.S. Cl. ..... 84/421

[58] Field of Search ..... 84/421, 379, 387 A; 248/164, 166, 431

[56] References Cited

U.S. PATENT DOCUMENTS

| | | | |
|---|---|---|---|
| 1,837,637 | 12/1931 | Walberg | 84/421 |
| 3,433,115 | 3/1969 | Kjelstrom | 84/421 X |
| 3,893,363 | 7/1975 | Cohen | 84/421 X |
| 4,252,047 | 2/1981 | Gauger | 84/421 |
| 4,256,007 | 3/1981 | Streit | 84/421 |
| 4,479,414 | 10/1984 | Willis | 84/421 |

*Primary Examiner*—Brian W. Brown
*Assistant Examiner*—Howard B. Blankenship
*Attorney, Agent, or Firm*—Neal J. Mosely

[57] ABSTRACT

A marching percussion instrument stand has a new and useful improvement for mounting percussion instruments to a stand by a musician-member of a marching band. The device includes a plurality of vertical mounting bars, supported by, and attached in an offset position above horizontally disposed support bars or feet. The vertical mounting bars are attached in an x-shape and carry supporting tubes each of which, in turn, support with the assistance of set-screws, solid, cylindrical rods for mounting a variety of percussion instruments. In one embodiment, the device is used in combination with a conventional dual arm vest carrier for supporting a plurality of drums. In another embodiment, the device is used to support a single marching snare drum. The utility of the device is illustrated in the fact that it can further be used to support any size bass drum in a vertical or angled playing position. The foregoing elements may be assembled in such a manner as to provide placement in a wide variety of adjustments for width, height and angle.

26 Claims, 2 Drawing Sheets

FIG. 2
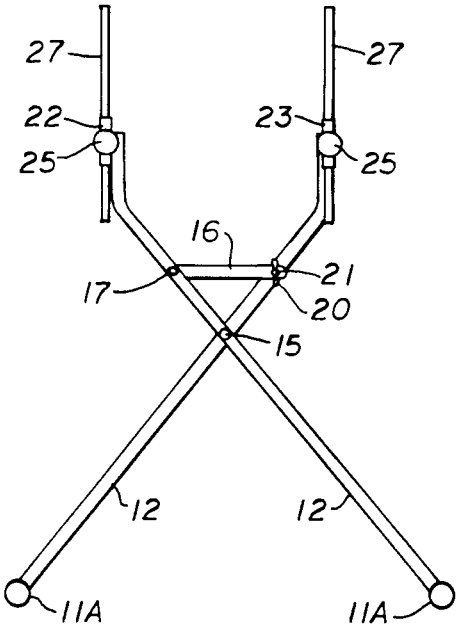
FIG. 3
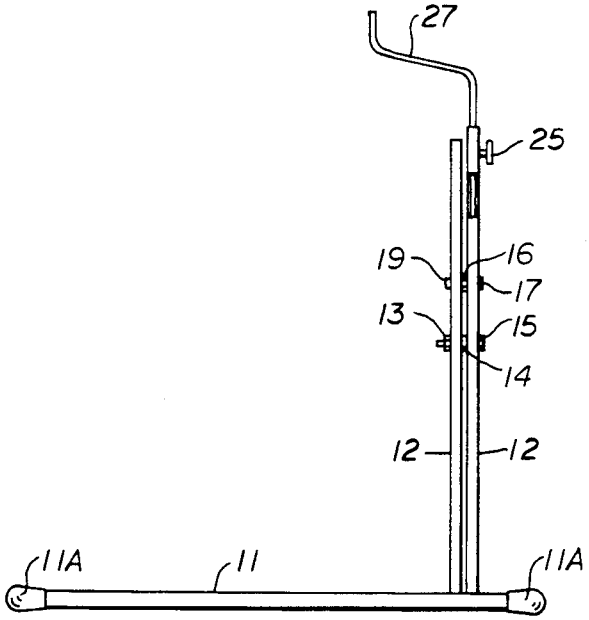
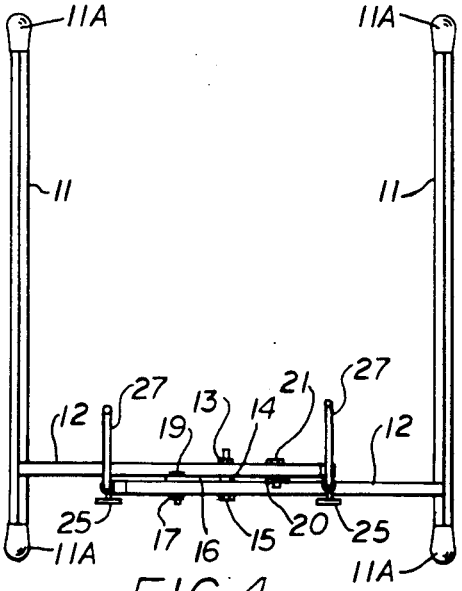
FIG. 4
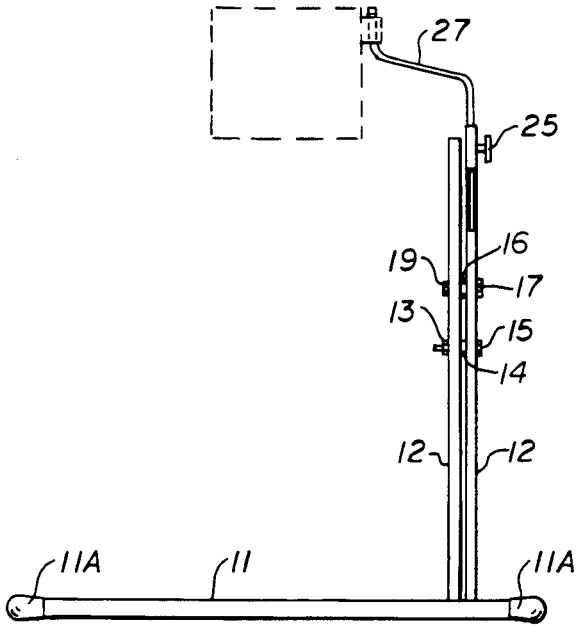
FIG. 5

MARCHING PERCUSSION INSTRUMENT STAND

BACKGROUND OF THE INVENTION

1. Field of the Invention

This invention relates generally to musical instrument supports, and more particularly to a stand or support used to position a single instrument, or an array of drums, cymbals and other percussion instruments, in position to be played by a musician.

2. Brief Description of the Prior Art

A variety of percussion musical instrument stands or supports are known in the prior art Examples of relevant prior art may be seen in Walberg U.S. Pat. No. 1,837,637; Kjelstrom U.S. Pat. No. 3,433,115; Cohen U.S. Pat. No. 3,893,363; Gauger U.S. Pat. No. 4,252,047; Streit U.S. Pat. No. 4,256,007; and Willis U.S. Pat. No. 4,479,414.

Walberg U.S. Pat. No. 1,837,637 teaches a stand for holding a snare drum which is foldable into a small compass for transportation and in which the arms of the stand can be brought into position parallel with the vertical standard by which it is supported. This device offers an effective means for gripping the sides of the drum without marring it, and includes an adjustment by which the device could be readily changed to adapt it to hold drums of different sizes.

Kjelstrom U.S. Pat. No. 3,433,115 discloses a relatively light drum set mounted on a collapsible support structure that permits the drum set to be dismantled into relatively small pieces for transportation and storage. A stanchion extending upward from a collapsible base structure carries at its upper end a support head which in itself is a percussion instrument, and an array of drums is adjustably and removably mounted on this upper support head.

Cohen U.S. Pat. No. 3,893,363 teaches a kit which is particularly useful for mounting percussion instruments to a stand. The kit includes a plurality of mounting bars each formed with a plurality of apertures, and a plurality of like rods attachable to the bars for supporting various percussion instruments.

Gauger U.S. Pat. No. 4,252,047 discloses a stand for mounting floor drums which consists of an arcuate member having inwardly directed flanges which have apertures therein for mounting to the lugs of the drum between the castings and the rim. Vibration-absorbing grommets are provided in the flanges in order to provide a resilient support and isolate the stand from the vibration of the drum. Brackets are provided at diametrically opposite parts of the arcuate member for clamping leg members. The stand may be adjusted for both angular and vertical position relative to the leg members.

Streit U.S. Pat. No. 4,256,007 teaches a percussion instrument carrier particularly adapted for marching. The instrument carrier comprises a rigid frame having a pair of spaced-apart hook members for contacting the shoulder blades of the marcher, an integral rear support portion adapted to rest upon the back of the marcher, a pair of forwardly-projecting, spaced-apart arm members for securing the percussion instrument in a playing position, and means for coupling the arm members to the supportive frame at a height convenient to the marcher.

Willis U.S. Pat. No. 4,479,414 discloses a multiple drum support assembly containing several supports for positioning drums and cymbals in playing position, the support being attached to a bass drum or a pair of bass drums. The support can be folded into a storage or travel position wherein all auxiliary drum supports are parallel to each other.

The present invention is distinguished over the prior art in general, and these patents in particular by a marching percussion instrument stand which has a new and useful improvement for mounting percussion instruments to a stand by a musician-member of a marching band. The device includes a plurality of vertical mounting bars, supported by, and attached in an offset position above horizontally disposed support bars or feet. The vertical mounting bars are attached in an x-shape and carry supporting tubes each of which, in turn, support with the assistance of set-screws, solid, cylindrical rods for mounting a variety of percussion instruments. In one embodiment, the device is used in combination with a conventional dual arm vest carrier for supporting a plurality of drums. In another embodiment, the device is used to support a single marching snare drum The utility of the device is illustrated in the fact that it can further be used to support any size bass drum in a vertical or angled playing position The foregoing elements may be assembled in such a manner as to provide placement in a wide variety of adjustments for width, height and angle.

SUMMARY OF THE INVENTION

It is therefore one object of the present invention to provide a marching percussion instrument stand which is a new and useful improvement for mounting percussion instruments to a stand by a musician-member of a marching band.

It is another object of this invention to provide a marching percussion instrument stand which can be used in combination with a dual arm vest carrier for supporting several drums.

Another object of this invention is to provide a marching percussion instrument stand which can be used to support a single marching snare drum.

Another object of this invention is to provide a marching percussion instrument stand which can be used to support any size bass drum in a vertical or angled playing position.

A further object of this invention is to provide a marching percussion instrument stand with supporting legs shaped to fit between benches in a stadium or auditorium.

A further object of this invention is to provide a marching percussion instrument stand with supporting legs shaped to fit between benches in a stadium or auditorium and arranged to support an instrument with its center of gravity over the supporting legs.

A still further object of this invention is to provide a marching percussion instrument stand with supporting legs shaped to fit between benches in a stadium or auditorium and arranged to support an instrument with its center of gravity over the supporting legs and having supporting arms adjustable in width and height to accommodate different sized and shaped instruments.

A still further object of this invention is to provide a marching percussion instrument stand which may be assembled in such a manner as to provide placement in a wide variety of adjustments for width, height and angle.

Other objects of the invention will become apparent from time to time throughout the specification and claims as hereinafter related.

The above noted objects and other objects of the invention are accomplished by a marching percussion instrument stand which has a new and useful improvement for mounting percussion instruments to a stand by a musician-member of a marching band. The device includes a plurality of vertical mounting bars, supported by, and attached in an offset position above horizontally disposed support bars or feet. The vertical mounting bars are attached in an x-shape and carry supporting tubes each of which, in turn, support with the assistance of set-screws, solid, cylindrical rods for mounting a variety of percussion instruments. In one embodiment, the device is used in combination with a dual arm vest carrier for supporting a plurality of drums. In another embodiment, the device is used to support a single marching snare drum. The utility of the device is illustrated in the fact that it can further be used to support any size bass drum in a vertical or angled playing position. The foregoing elements may be assembled in such a manner as to provide placement in a wide variety of adjustments for width, height and angle.

BRIEF DESCRIPTION OF THE DRAWINGS

FIG. 2 is a front elevation view of the marching percussion instrument stand.

FIG. 3 is a side elevation view of the marching percussion instrument stand.

FIG. 4 is a plan view of the marching percussion instrument stand.

FIG. 5 is a side elevation view of the marching percussion instrument stand; the stand is shown supporting a drum, which is not part of the present invention, the drum being shown in dotted lines.

DESCRIPTION OF THE PREFERRED EMBODIMENT

Figure 1:
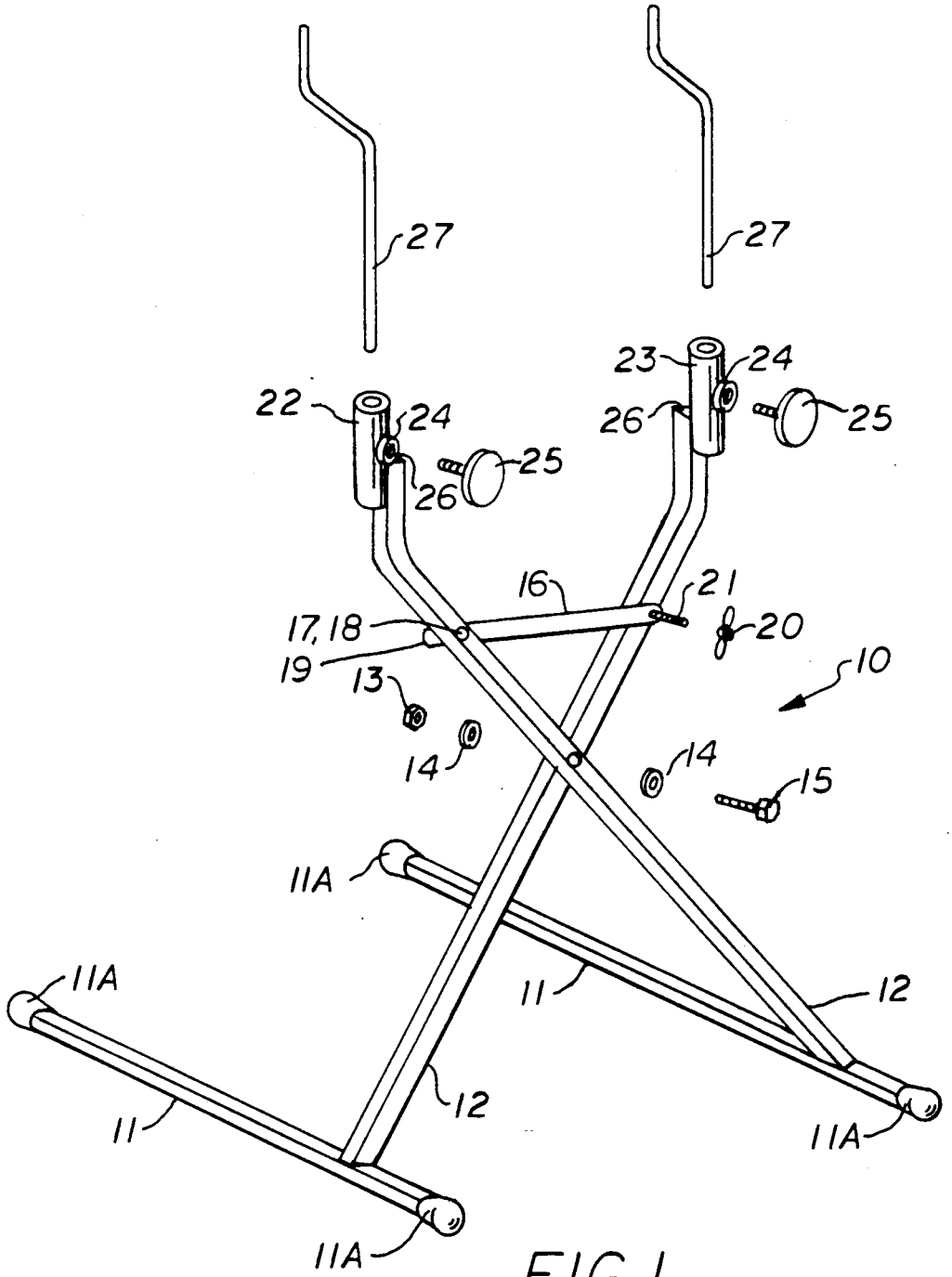
FIG. 1 is an exploded isometric view of the marching percussion instrument stand in accordance with the present invention.

Referring to the drawings by numerals of reference, there is shown in FIGS. 1–5, a preferred musical instrument stand 10 which is particularly useful for holding and supporting percussion instruments typically found in a marching band.

The stand 10 comprises a pair of horizontally displaced bars or feet 11 which form the base of the stand. The horizontal bars 11 are spaced apart beneath the center of gravity of the percussion instrument or instruments supported by the stand. The bars 11 have a square cross-section and are manufactured of relatively light-weight material. In the preferred embodiment, the bars 11 are hollow square cross-section tubing of metal. The ends of the bars 11 are covered by suitable protecting covers 11A of rubber or plastic or like material.

As shown in FIGS. 1–2, the horizontal bars 11 are attached to vertical bars 12 as described hereinafter and rotated inwardly at an angle of 45° with respect to the horizontal and vertical planes. The principal supporting members of the stand 10 are the vertically disposed bars 12 which are welded, or otherwise permanently attached, to the horizontal bars 11. The vertical bars 12 are held together by a conventional nut 13, bolt 15, and a plurality of washers 14. The vertical bars 12 have a square cross-section and are manufactured of relatively light-weight material. In the preferred embodiment, the bars 12 are hollow square cross-section tubing of metal. The upper ends of bars 12 have suitable protecting caps 26 of plastic or rubber or other elastomeric material.

As shown in FIGS. 1, 3 and 4, and more particularly in FIG. 5, vertical bars 12 are attached to the horizontal bars or feet 11 near one end thereof. This offset positioning (see FIG. 5) of vertical bars 12 allows the supported drum or instrument to be supported by the stand 10 in a position such that the center of gravity is lower and substantially centered over the feet. This feature creates a greater degree of stability of the combination of the stand and instrument than is offered by most prior art devices.

Vertical bars have a brace 16 attached thereto by a conventional nut 17, bolt 19, and a plurality of washers 18. Brace 16 is attached at the same horizontal level to the other vertical bar by a conventional wing nut 20, and bolt 21. The bolt 21 is welded, or otherwise permanently attached, to the said vertical bar. In the preferred embodiment, the brace 16 is metal, and the nuts and bolts and washers are also metal, with the wing nut 20 being stainless steel.

Vertical bars 12 extend a short distance above the point at which brace 16 is attached As shown in FIGS. 1–2, the upper ends of vertical bars 12 are bent at an angle such that they extent vertically from the lower portions which form an x-support.

A first hollow cylindrical member 22 is welded, or otherwise permanently attached, to the upper end of one of the vertical bars 12, on the side and at the upper end thereof. The first cylindrical member 22 extends parallel to the upper end of the vertical bar 12 and extends a short distance above the upper end thereof. The first cylindrical member 22 is welded on the outside of the stand 10 with respect to the centerline of the stand 10 and supported instrument.

A second hollow cylindrical member 23 is welded, or otherwise permanently attached, to the other vertical bar 12, on the side and at the upper end thereof and extends parallel thereto for a short distance above the upper end thereof. The second cylindrical member 23 is welded on the outside of the stand 10 with respect to the centerline of the stand 10 and supported instrument. The second cylindrical member 23 is parallel to first cylindrical member 22 with respect to the plane defined by the centerline of brace 16.

In the preferred embodiment, the first hollow cylindrical member 22 and the second hollow cylindrical member 23 are metal. Both the first hollow cylindrical member 22 and the second hollow cylindrical member 23 have a nut 24 welded, or otherwise permanently attached on the side. As shown in FIG. 1, both of said nuts 24 are located at a point a short distance above the top-most point of said vertical members 12. The side of the hollow cylindrical members 22 and 23 to which said nuts 24 are welded is outside of the stand 10, and away from the supported instrument. Each of the nuts 24 is threaded and receives a threaded shaft of a set-screw 25 (see FIG. 1).

In the preferred embodiment, the handles of set-screws 25 are plastic or plastic coated. By selectively operating said handles, the elevation at which the instrument is supported can be varied by raising and lowering the curved supporting bars or rods 27. The curved rods 27, preferably of stainless steel, are movable to be placed in the marching attaching lugs of the supported instrument in the preferred embodiment.

In one embodiment, the device is used in combination with a conventional dual arm vest carrier for supporting a plurality of drums. In another embodiment, the device is used to support a single marching snare drum. The utility of the device is illustrated in the fact that it can further be used to support any size bass drum in a vertical or angled playing position.

OPERATION

The operation of the marching percussion instrument stand should be obvious from the above description; however, it will be stated herein for clarity.

The stand 10, in accordance with the present invention, is placed on a flat surface by a musician. It can straddle bench type seats as in a stadium or auditorium. The percussion instrument to be supported on the stand 10 is attached to the stand 10 by inserting the rods 27 into the appropriate attaching lugs of the supported instrument.

The musician can raise and lower the instrument to the desired height for playing by operating the setscrews 25, which thereby allows the supporting rods 27, which are held in place thereby, to be raised or lowered.

In one embodiment, the stand is used in combination with a conventional dual arm vest carrier for supporting a plurality of drums. In another embodiment, the stand is used to support a single marching snare drum. The utility of the device is illustrated in the fact that it can further be used to support any size bass drum in a vertical or angled playing position.

While this invention has been described fully and completely with special emphasis upon a preferred embodiment, it should be understood that within the scope of the appended claims the invention may be practiced otherwise than as specifically described herein.

I claim:

1. A marching percussion instrument stand comprising:

a pair of elongated feet members oriented to support said stand along their entire length, a pair of elongated support members, each having one end secured on one of said elongated feet members adjacent to one end thereof, means securing said support members together at about the midpoint thereof for pivotal movement between a collapsed position with said feet members adjacent to each other in parallel relation and an opened position with said feet members spaced apart from each other in parallel relation, the other ends of said support members being bent to be in parallel relation when in said opened position, releasable means for securing said support members in said opened position, and a pair of adjustable members adjustably supported on said bent ends of said support members having ends shaped to cooperate with supporting means on a percussion instrument.

2. A marching percussion instrument stand according to claim 1 in which:

said bent ends of said support members each have a tubular support secured thereon, and said pair of adjustable members are adjustably supported in said tubular supports.

3. A marching percussion instrument stand according to claim 2 in which:

each said tubular support has a set screw secured therein, and said set screws are operable to secure said adjustable members at selected positions in said tubular supports.

4. A marching percussion instrument stand according to claim 1 in which:

said releasable means for securing said support members in said opened position include a brace pivotally attached at one end to one said support member and releasably attached at the other end to the other said support member , and said brace is positioned above the midpoint at about which said support members are secured for pivotal movement.

5. A marching percussion instrument stand according to claim 4 in which:

said brace is held in place by nuts and bolts.

6. A marching percussion instrument stand according to claim 1 in which:

said bent ends of said support members each have a tubular support secured thereon, said pair of adjustable members are solid cylindrical members, and said tubular supports are hollow cylindrical members.

7. A marching percussion instrument stand according to claim 6 in which:

each of said solid cylindrical members has a sliding fit in said hollow cylindrical members.

8. A marching percussion instrument stand according to claim 7 in which:

each of said solid cylindrical members has an elongated portion fitting said hollow cylindrical members and a bent and rebent portion with an end portion substantially parallel to said elongated portion operable on rotation in said hollow cylindrical members to adjust the distance between said end portions, said end portions being sized to fit the support members of a marching band instrument supporting harness.

9. A marching percussion instrument stand according to claim 1 in which:

said feet members have protective coverings at both ends, and said elongated support members have protective coverings adjacent the bent ends.

10. A marching percussion instrument stand according to claim 9 in which:

said protective coverings are elastomeric material.

11. A marching percussion instrument stand according to claim 1 in which:

said feet members and said elongated support members are square metal tubing secured together by welding.

12. A marching percussion instrument stand according to claim 1 in which:

said bent ends of said support members each have a tubular support secured thereon, said pair of adjustable members are adjustably supported in said tubular supports, each said tubular support has a set screw secured therein, and said set screws are operable to secure said adjustable members at selected positions in said tubular supports.

13. A marching percussion instrument stand according to claim 1 in which:

said bent ends of said support members each have a tubular support secured thereon, said pair of adjustable members are adjustably supported in said tubular supports, said releasable means for securing said support members in said opened position include a brace pivotally attached at one end to one said support member and releasably attached at the other end to the other said support member, and said brace is positioned above the midpoint at about which said support members are secured for pivotal movement.

14. A marching percussion instrument stand according to claim 1 in which:

said bent ends of said support members each have a tubular support secured thereon, said pair of adjustable members are adjustably supported in said tubular supports, said releasable means for securing said support members in said opened position include a brace pivotally attached at one end to one said support member and releasably attached at the other end to the other said support member, said brace is positioned above the midpoint at about which said support members are secured for pivotal movement, and said brace is held in place by nuts and bolts.

15. A marching percussion instrument stand according to claim 1 in which:

said bent ends of said support members each have a tubular support secured thereon, said pair of adjustable members are adjustably supported in said tubular supports, said pair of adjustable members are solid cylindrical members, and said tubular supports are hollow cylindrical members.

16. A marching percussion instrument stand according to claim 1 in which:

said bent ends of said support members each have a tubular support secured thereon, said pair of adjustable members are adjustably supported in said tubular supports, said pair of adjustable members are solid cylindrical members, said tubular supports are hollow cylindrical members, and each of said solid cylindrical members has a sliding fit in said hollow cylindrical members.

17. A marching percussion instrument stand according to claim 1 in which:

said bent ends of said support members each have a tubular support secured thereon, said pair of adjustable members are adjustably supported in said tubular supports, said pair of adjustable members are solid cylindrical members, said tubular supports are hollow cylindrical members, each of said solid cylindrical members has a sliding fit in said hollow cylindrical members, each of said solid cylindrical members has an elongated portion fitted said hollow cylindrical members and a bent and rebent portion with an end portion substantially parallel to said elongated portion operable on rotation in said hollow cylindrical members to adjust the distance between said end portions, and said end portions being sized to fit support members of a marching band instrument supporting harness.

18. A marching percussion instrument stand according to claim 1 in which:

said bent ends of said support members each have a tubular support secured thereon, said pair of adjustable members are adjustably supported in said tubular supports, said pair of adjustable members are solid cylindrical members, said tubular supports are hollow cylindrical members, each of said solid cylindrical members has a sliding fit in said hollow cylindrical members, each of said solid cylindrical members has an elongated portion fitted said hollow cylindrical members and a bent and rebent portion with an end portion substantially parallel to said elongated portion operable on rotation in said hollow cylindrical members to adjust the distance between said end portions, said end portions being sized to fit support members of a marching band instrument supporting harness, said feet members have protective coverings at both ends, and said elongated support members have protective coverings adjacent the bent ends.

19. A marching percussion instrument stand according to claim 1 in which:

said bent ends of said support members each have a tubular support secured thereon, said pair of adjustable members are adjustably supported in said tubular supports, said pair of adjustable members are solid cylindrical members, said tubular supports are hollow cylindrical members, each of said solid cylindrical members has a sliding fit in said hollow cylindrical members, each of said solid cylindrical members has an elongated portion fitted said hollow cylindrical members and a bent and rebent portion with an end portion substantially parallel to said elongated portion operable on rotation in said hollow cylindrical members to adjust the distance between said end portions, said end portions being sized to fit support members of a marching band instrument supporting harness, said feet members have protective coverings at both ends, said elongated support members have protective coverings of elastomeric material adjacent the bent ends.

20. A marching percussion instrument stand according to claim 1 in which:

said bent ends of said support members each have a tubular support secured thereon, said pair of adjustable members are adjustably supported in said tubular supports, said pair of adjustable members are solid cylindrical members, said tubular supports are hollow cylindrical members, each of said solid cylindrical members has a sliding fit in said hollow cylindrical members, each of said solid cylindrical members has an elongated portion fitted said hollow cylindrical members and a bent and rebent portion with an end portion substantially parallel to said elongated portion operable on rotation in said hollow cylindrical members to adjust the distance between said end portions, said end portions being sized to fit support members of a marching band instrument supporting harness, said feet members have protective coverings at both ends, said elongated support members have protective coverings adjacent bent ends, and said feet members and said elongated support members are square metal tubing secured together by welding.

21. A marching percussion instrument stand according to claim 1 in which:

said bent ends of said support members each have a tubular support secured thereon, said pair of adjustable members are adjustably supported in said tubular supports, said pair of adjustable members are solid cylindrical members, said tubular supports are hollow cylindrical members, each of said solid cylindrical members has a sliding fit in said hollow cylindrical members, each of said solid cylindrical members has an elongated portion fitted said hollow cylindrical members and a bent and rebent portion with an end portion substantially parallel to said elongated portion operable on rotation in said hollow cylindrical members to adjust the distance between said end portions, said end portions being sized to fit support members of a marching band instrument supporting harness, each said hollow cylindrical member has a set screw secured therein, and said set screws are operable to secure said solid cylindrical members at selected positions in said hollow cylindrical members, said feet members have protective coverings at both ends, said elongated support members have protective coverings adjacent the bent ends, and said feet members and said elongated support members are square metal tubing secured together by welding.

22. A marching percussion instrument stand according to claim 1 in which:

said releasable means for securing said support members in said opened position include a brace pivotally attached at one end to one said support member and releasably attached at the other end to the other said support member, said brace is positioned above the midpoint at about which said support members are secured for pivotal movement, said bent ends of said support members each have a tubular support secured thereon, said pair of adjustable members are adjustably supported in said tubular supports, said pair of adjustable members are solid cylindrical members, said tubular supports are hollow cylindrical members, each of said solid cylindrical members has a sliding fit in said hollow cylindrical members, each of said solid cylindrical members has an elongated portion fitted said hollow cylindrical members and a bent and rebent portion with an end portion substantially parallel to said elongated portion operable on rotation in said hollow cylindrical members to adjust the distance between said end portions, said end portions being sized to fit support members of a marching band instrument supporting harness, each said hollow cylindrical member has a set screw secured therein, and said set screws are operable to secure said solid cylindrical members at selected positions in said hollow cylindrical members, said feet members have protective coverings at both ends, said elongated support members have protective coverings adjacent the bent ends, and said feet members and said elongated support members are square metal tubing secured together by welding.

23. The combination with an instrument stand as defined in claim 1 of a percussion instrument having support members for fitting a marching harness, said instrument support members fitting said instrument stand adjustable members.

24. The combination with an instrument stand as defined in claim 1 of a marching drum having support members for fitting a marching harness, said drum support members fitting said instrument stand adjustable members.

25. The combination with an instrument stand as defined in claim 6 of a percussion instrument having support members for fitting a marching harness, said instrument support members fitting said instrument stand solid cylindrical members.

26. The combination with an instrument stand as defined in claim 6 of a marching drum having support members for fitting a marching harness, said drum support members fitting said instrument stand solid cylindrical members.

* * * * *